US012577031B2

(12) United States Patent
Iyer et al.

(10) Patent No.: US 12,577,031 B2
(45) Date of Patent: Mar. 17, 2026

(54) BIODEGRADABLE COOLER

(71) Applicant: Igloo Products Corp., Katy, TX (US)

(72) Inventors: Vasanthi Iyer, Katy, TX (US); John Maldonado, Katy, TX (US); Roque Barros, Katy, TX (US)

(73) Assignee: Igloo Products Corp., Katy, TX (US)

( * ) Notice: Subject to any disclaimer, the term of this patent is extended or adjusted under 35 U.S.C. 154(b) by 60 days.

(21) Appl. No.: 17/000,897

(22) Filed: Aug. 24, 2020

(65) Prior Publication Data

US 2021/0070528 A1 Mar. 11, 2021

Related U.S. Application Data

(60) Provisional application No. 62/898,117, filed on Sep. 10, 2019.

(51) Int. Cl.
*B65D 81/38* (2006.01)
*B65D 5/46* (2006.01)
(Continued)

(52) U.S. Cl.
CPC ..... *B65D 81/3823* (2013.01); *B65D 5/46088* (2013.01); *B65D 65/466* (2013.01);
(Continued)

(58) Field of Classification Search
CPC ..... B65D 81/3858; B65D 65/466; B65D 5/46088; B65D 81/3823; B65D 5/46112; B65D 5/46144; B65D 5/241; B65D 5/4266; B65D 5/46096; B65D 81/38; B65D 81/3813; B65D 31/10; B65D 33/065; B65D 5/46032; Y02W 90/10; Y02W 30/80
USPC ..... 229/103.11, 117.14, 186, 103, 122.32, 229/112, 117.12, 117.22, 117.27, 117.35; 206/427; 62/457.7
See application file for complete search history.

(56) References Cited

U.S. PATENT DOCUMENTS 2,181,150 A 11/1939 Pittenger
2,613,847 A 10/1952 John
(Continued)

FOREIGN PATENT DOCUMENTS

AU 2707277 1/1979
AU 83403 9/1981
(Continued)

OTHER PUBLICATIONS

Search Report and Written Opinion From Corresponding PCT Application No. PCT/US2020/047621, mailed Oct. 6, 2020, 13 pages.
(Continued)

*Primary Examiner* — Christopher R Demeree
(74) *Attorney, Agent, or Firm* — Dinsmore & Shohl LLP

(57) ABSTRACT

A biodegradable cooler includes an outer shell that includes a base; support walls coupled to the base, roof sections extending from the support walls. The base, the support walls, and the roof sections define a cavity of the outer shell. The outer shell further includes handle sections extending from the roof sections. The handle sections are attached to each other when the outer shell is closed. The biodegradable cooler further includes a liner disposed within in the cavity of the outer shell. The liner is made from one or more biodegradable materials.

15 Claims, 6 Drawing Sheets

(51) Int. Cl.
*B65D 65/46* (2006.01)
*F25D 3/08* (2006.01)

(52) U.S. Cl.
CPC ..... *B65D 81/3858* (2013.01); *F25D 3/08* (2013.01); *F25D 2331/804* (2013.01)

(56) References Cited

U.S. PATENT DOCUMENTS 2,844,299 A * 7/1958 Kessler ..... B65D 5/46032 229/117.22
3,194,462 A 7/1965 Tupper
3,266,623 A 8/1966 Poferl
3,581,930 A 6/1971 Gunnink
3,791,547 A 2/1974 Branscum
4,047,633 A 9/1977 Trombly
4,213,310 A 7/1980 Buss
D257,934 S 1/1981 Buss
4,344,300 A 8/1982 Taylor
D267,444 S 1/1983 Ruxton
D268,979 S 5/1983 Ruxton
D269,398 S 6/1983 Ruxton
4,592,482 A 6/1986 Seager
D289,597 S 5/1987 Averitt
D292,056 S 9/1987 Decker
4,696,412 A 9/1987 McGowan
4,802,344 A 2/1989 Livingston et al.
4,823,554 A 4/1989 Trachtenberg et al.
D305,197 S 12/1989 Valdes
D307,998 S 5/1990 Costello
4,978,023 A 12/1990 Behlmann et al.
5,050,999 A 9/1991 Van Loon, III
D323,950 S 2/1992 Pleet
5,111,664 A 5/1992 Yang
5,154,309 A 10/1992 Wischusen, III et al.
5,165,583 A 11/1992 Kouwenberg
5,263,339 A 11/1993 Evans
5,284,294 A 2/1994 Floyd
5,307,647 A 5/1994 Mcclure
5,319,937 A 6/1994 Fritsch
D349,007 S 7/1994 Costello
5,335,809 A 8/1994 Toida et al.
D352,420 S 11/1994 Costello
5,427,308 A 6/1995 Swift et al.
5,582,343 A 12/1996 Dalvey
5,700,586 A 12/1997 Laiho et al.
5,797,528 A 8/1998 McDuffie
D400,053 S 10/1998 Coffee
5,853,121 A * 12/1998 Francisco ..... B65D 5/2047 229/117.14
5,860,281 A 1/1999 Coffee
5,924,302 A 7/1999 Derifield
6,085,926 A 7/2000 Weiss
6,295,830 B1 10/2001 Newman
6,334,329 B1 1/2002 Weller
D479,951 S 9/2003 Segura
6,615,985 B1 9/2003 Foreman
6,675,998 B2 1/2004 Forsman et al.
D486,357 S 2/2004 Eba
6,705,469 B2 3/2004 Slot
D497,517 S 10/2004 Reuter
D500,057 S 12/2004 Reuter
6,837,420 B2 * 1/2005 Westerman ..... B65D 5/2057 229/117.15
6,962,263 B2 11/2005 Cadiente et al.
7,051,550 B2 5/2006 Roth
D527,226 S 8/2006 Maldonado
D528,368 S 9/2006 Maldonado
D529,344 S 10/2006 Maldonado
7,140,507 B2 11/2006 Maldonado
D534,771 S 1/2007 Zorn
7,344,028 B2 3/2008 Hanson
7,451,709 B2 11/2008 Swartfager et al.
8,348,509 B2 1/2013 Wilkes et al.
8,356,712 B2 1/2013 Piazza, Jr.
8,408,620 B2 4/2013 Gruppioni
D696,790 S 12/2013 Nemeth
8,763,811 B2 7/2014 Lantz
D717,469 S 11/2014 Nemeth
8,919,082 B1 12/2014 Cataldo
D734,642 S * 7/2015 Vasbinder ..... D7/605
9,199,782 B1 12/2015 Cliatt
9,366,467 B2 6/2016 Kiedaisch
9,499,294 B1 * 11/2016 Costanzo, Jr. ..... B65D 5/4608
9,550,618 B1 1/2017 Jobe
9,616,313 B2 4/2017 Townsend
D792,486 S 7/2017 Li
9,751,683 B1 9/2017 Jobe
D802,028 S 11/2017 Li
D802,029 S 11/2017 Li
D802,630 S 11/2017 Li
9,908,022 B1 3/2018 Bowe
9,957,098 B2 5/2018 Jobe
D820,049 S 6/2018 Ahlstrom
10,046,901 B1 8/2018 Jobe
10,059,495 B1 8/2018 Korustan et al.
10,093,460 B2 10/2018 Seiders et al.
D836,993 S 1/2019 Meda
D836,994 S 1/2019 Meda
10,167,184 B1 1/2019 Samples
D844,386 S 4/2019 Ahlstrom
D844,432 S 4/2019 Bliss et al.
10,307,761 B2 6/2019 Schryver
10,392,177 B2 8/2019 Lantz
10,551,110 B2 2/2020 Waltermire et al.
10,597,219 B2 3/2020 Jobe
10,618,690 B2 4/2020 Jobe
10,625,923 B2 4/2020 Jobe
10,625,925 B1 4/2020 Jobe
10,633,165 B2 * 4/2020 Aksan ..... B65D 81/3862
10,647,497 B2 5/2020 Jobe
D887,788 S 6/2020 Meda
D888,503 S 6/2020 Meda
D894,043 S 8/2020 Meda
10,765,594 B2 9/2020 Sanchez
10,800,595 B2 * 10/2020 Waltermire ..... B65D 81/3897
10,807,788 B2 10/2020 Jobe
D901,986 S 11/2020 Meda
10,843,840 B2 * 11/2020 Sollie ..... B65D 81/3858
D904,830 S 12/2020 Meda
D907,074 S 1/2021 Yang
10,947,025 B2 * 3/2021 Sollie ..... B65D 81/3858
D920,743 S 6/2021 Meda
D921,439 S 6/2021 Meda
11,027,875 B2 * 6/2021 Sollie ..... B65D 81/3853
11,027,885 B2 6/2021 Duong
11,040,818 B2 6/2021 Jobe
11,066,228 B2 * 7/2021 Sollie ..... B65D 5/64
11,072,483 B2 7/2021 Jobe
D927,938 S 8/2021 Meda
D929,471 S 8/2021 Meda
11,097,886 B2 8/2021 Lantz
D933,449 S 10/2021 Ahlström
11,142,371 B2 10/2021 Jobe
11,142,383 B2 * 10/2021 Thompson ..... B65D 71/36
D935,280 S 11/2021 Thelin
11,230,404 B2 * 1/2022 Sollie ..... B65D 5/5415
11,247,827 B2 2/2022 Jobe
D953,814 S 6/2022 Thelin
D954,764 S 6/2022 Meda
11,358,780 B2 6/2022 Jobe
11,359,848 B2 6/2022 Guan
11,772,866 B2 10/2023 Soto et al.
2002/0020104 A1 2/2002 Kolar et al.
2003/0216492 A1 11/2003 Bowden et al.
2004/0089582 A1 5/2004 Hendrix, Jr.
2004/0178208 A1 9/2004 Minh
2004/0226989 A1 11/2004 Cook et al.
2005/0035119 A1 2/2005 Hull et al.
2005/0103044 A1 5/2005 Mogil et al.
2005/0109776 A1 5/2005 Camp, Jr.
2005/0127081 A1 6/2005 Minh
2005/0150624 A1 7/2005 Toh et al.
2005/0198992 A1 9/2005 Mogil et al.
2005/0263432 A1 12/2005 Hanson

(56) References Cited

U.S. PATENT DOCUMENTS

| | | | |
|---|---|---|---|
| 2005/0263527 | A1 | 12/2005 | Maldonado |
| 2005/0263528 | A1 | 12/2005 | Maldonado |
| 2005/0279123 | A1 | 12/2005 | Maldonado |
| 2005/0279124 | A1 | 12/2005 | Maldonado |
| 2006/0163252 | A1 | 7/2006 | Zalewski |
| 2006/0175223 | A1 | 8/2006 | Casanovas |
| 2007/0023439 | A1 | 2/2007 | Vaughn |
| 2007/0125118 | A1 | 6/2007 | Hooper |
| 2007/0151685 | A1 | 7/2007 | Horsfield et al. |
| 2008/0001373 | A1 | 1/2008 | Vaughn |
| 2008/0006629 | A1 | 1/2008 | Roth |
| 2008/0011621 | A1 | 1/2008 | Liu et al. |
| 2008/0025544 | A1 | 1/2008 | Maldonado |
| 2009/0200301 | A1 | 8/2009 | Beekman et al. |
| 2010/0052353 | A1 | 3/2010 | Shea et al. |
| 2010/0065574 | A1 | 3/2010 | Brooks |
| 2010/0078442 | A1 | 4/2010 | Donchez et al. |
| 2010/0212351 | A1 | 8/2010 | Chapin et al. |
| 2010/0258574 | A1 | 10/2010 | Bentley |
| 2011/0182532 | A1 | 7/2011 | Baltus |
| 2011/0197625 | A1 | 8/2011 | Urban |
| 2012/0261411 | A1 | 10/2012 | Buchenan et al. |
| 2013/0112694 | A1 | 5/2013 | Bentley |
| 2013/0340467 | A1 | 12/2013 | Kiedaisch |
| 2014/0021206 | A1 | 1/2014 | Vernon et al. |
| 2014/0021208 | A1 | 1/2014 | Anti et al. |
| 2015/0053676 | A1 | 2/2015 | Sand |
| 2015/0158656 | A1 | 6/2015 | Mckinnon |
| 2015/0320191 | A1 | 11/2015 | Stevens |
| 2015/0344211 | A1 | 12/2015 | Moon |
| 2016/0052692 | A1 | 2/2016 | Branham |
| 2016/0304267 | A1 | 10/2016 | Aksan et al. |
| 2017/0023290 | A1 | 1/2017 | DeMuth |
| 2017/0043937 | A1 | 2/2017 | Lantz |
| 2017/0073146 | A1 | 3/2017 | Kuhn et al. |
| 2017/0101301 | A1 | 4/2017 | Volin |
| 2017/0355501 | A1 | 12/2017 | Furio |
| 2018/0141718 | A1 | 5/2018 | Ahlstrom |
| 2018/0162597 | A1 | 6/2018 | Jobe |
| 2018/0194534 | A1 | 7/2018 | Jobe |
| 2018/0201432 | A1 | 7/2018 | Harding |
| 2018/0229916 | A1 | 8/2018 | Jobe |
| 2018/0237184 | A1 | 8/2018 | Jobe |
| 2018/0237206 | A1 | 8/2018 | Jobe |
| 2018/0305109 | A1 | 10/2018 | Jobe |
| 2018/0327171 | A1 | 11/2018 | Waltermire et al. |
| 2018/0339838 | A1 | 11/2018 | Hall |
| 2019/0032991 | A1 | 1/2019 | Waltermire et al. |
| 2019/0039810 | A1 | 2/2019 | Tolman et al. |
| 2019/0047743 | A1 | 2/2019 | Costanzo, Jr. |
| 2019/0144664 | A1 | 5/2019 | Meyer et al. |
| 2019/0161240 | A1 | 5/2019 | Ahlstrom |
| 2019/0329961 | A1 | 10/2019 | Jobe |
| 2019/0367208 | A1 | 12/2019 | Jobe |
| 2019/0367209 | A1 | 12/2019 | Jobe |
| 2020/0062454 | A1 | 2/2020 | Duong |
| 2020/0102139 | A1 | 4/2020 | Jobe |
| 2020/0122909 | A1 | 4/2020 | Jobe |
| 2020/0140165 | A1 | 5/2020 | Maldonado |
| 2020/0180838 | A1 | 6/2020 | Lantz |
| 2020/0180846 | A1 | 6/2020 | Jobe |
| 2020/0216229 | A1 | 7/2020 | Weixian |
| 2020/0217571 | A1 | 7/2020 | Weixian |
| 2020/0217574 | A1 | 7/2020 | Thelin |
| 2020/0217575 | A1 | 7/2020 | Thelin |
| 2020/0217576 | A1 | 7/2020 | Weixian |
| 2020/0217578 | A1 | 7/2020 | Wang |
| 2020/0270053 | A1 | 8/2020 | Jobe |
| 2020/0307895 | A1 | 10/2020 | Jobe |
| 2020/0317425 | A1 | 10/2020 | Jobe |
| 2020/0407125 | A1 | 12/2020 | Markarian et al. |
| 2020/0407147 | A1 | 12/2020 | Jobe |
| 2021/0070523 | A1 | 3/2021 | Iyer |
| 2021/0070528 | A1 | 3/2021 | Iyer |
| 2021/0071930 | A1 | 3/2021 | Iyer |
| 2021/0123656 | A1 | 4/2021 | Barros |
| 2021/0127808 | A1 | 5/2021 | Thelin |
| 2021/0214123 | A1 | 7/2021 | Iyer |
| 2021/0229893 | A1 | 7/2021 | Maldonado |
| 2021/0253305 | A1 | 8/2021 | Duong |
| 2021/0285710 | A1 | 9/2021 | Barros |
| 2022/0114847 | A1 | 4/2022 | Emde |
| 2022/0114853 | A1 | 4/2022 | Emde |
| 2022/0119152 | A1 | 4/2022 | Blankinship |
| 2022/0154411 | A1 | 5/2022 | Henry, Jr. et al. |
| 2022/0219877 | A1 | 7/2022 | Jobe |
| 2022/0228406 | A1 | 7/2022 | Barros |
| 2022/0258946 | A1 | 8/2022 | Lantz |

FOREIGN PATENT DOCUMENTS

| | | | |
|---|---|---|---|
| AU | 83402 | | 4/1982 |
| AU | 93721 | | 10/1986 |
| AU | 2003200086 | B2 | 7/2003 |
| AU | 2005262599 | | 1/2006 |
| AU | 2011215734 | | 8/2012 |
| AU | 201712770 | | 5/2017 |
| AU | 201712777 | | 5/2017 |
| AU | 201712780 | | 5/2017 |
| AU | 201712782 | | 5/2017 |
| AU | 201712791 | | 5/2017 |
| AU | 201712799 | | 5/2017 |
| AU | 201712802 | | 5/2017 |
| AU | 201712803 | | 5/2017 |
| AU | 201712785 | | 7/2017 |
| AU | 201716789 | | 11/2017 |
| AU | 201716791 | | 11/2017 |
| AU | 201717667 | | 1/2018 |
| AU | 201717669 | | 1/2018 |
| AU | 201717670 | | 1/2018 |
| AU | 201717674 | | 1/2018 |
| AU | 201717676 | | 1/2018 |
| AU | 201717662 | | 2/2018 |
| AU | 2016304711 | | 3/2018 |
| AU | 2017240890 | | 11/2018 |
| AU | 201816061 | | 1/2019 |
| AU | 201910011 | | 2/2019 |
| AU | 201913598 | | 8/2019 |
| AU | 201913601 | | 8/2019 |
| AU | 201913603 | | 8/2019 |
| AU | 201913604 | | 8/2019 |
| AU | 201913607 | | 8/2019 |
| AU | 201913624 | | 8/2019 |
| AU | 201913626 | | 8/2019 |
| AU | 201913627 | | 8/2019 |
| AU | 201913631 | | 8/2019 |
| AU | 201913633 | | 8/2019 |
| AU | 202012545 | | 6/2020 |
| AU | 202012548 | | 6/2020 |
| AU | 2019284128 | | 7/2020 |
| AU | 2019284129 | | 7/2020 |
| AU | 2019284130 | | 7/2020 |
| AU | 2019284131 | | 7/2020 |
| AU | 2019284133 | | 7/2020 |
| AU | 2019284134 | | 7/2020 |
| AU | 2019302329 | | 1/2021 |
| AU | 2019325454 | | 1/2021 |
| AU | 2019376154 | | 3/2021 |
| AU | 2019371335 | | 5/2021 |
| AU | 2021225159 | | 9/2021 |
| CA | 48429 | | 7/1981 |
| CA | 48762 | | 10/1981 |
| CA | 53100 | | 7/1984 |
| CA | 1281859 | | 3/1991 |
| CA | 2229259 | | 8/1998 |
| CA | 2460597 | | 9/2004 |
| CA | 2570413 | | 1/2006 |
| CA | 2789507 | | 8/2011 |
| CA | 2746906 | A1 | 1/2013 |
| CA | 2995339 | | 2/2017 |
| CA | 3019638 | | 10/2017 |
| CA | 3059900 | | 8/2018 |
| CA | 3059901 | | 8/2018 |
| CA | 179459 | | 12/2018 |

(56) References Cited

FOREIGN PATENT DOCUMENTS

| | | | |
|---|---|---|---|
| CA | 179460 | | 12/2018 |
| CA | 3013722 | A1 | 2/2019 |
| CA | 3105713 | | 1/2020 |
| CA | 3106550 | | 2/2020 |
| CA | 3117297 | | 5/2020 |
| CA | 214387 | | 7/2022 |
| CN | 1047730 | A | 12/1990 |
| CN | 1446735 | A | 10/2003 |
| CN | 2812647 | Y | 9/2006 |
| CN | 201182279 | Y | 1/2009 |
| CN | 101370699 | | 2/2009 |
| CN | 101431913 | | 5/2009 |
| CN | 201235982 | Y | 5/2009 |
| CN | 202980512 | U | 6/2013 |
| CN | 106068433 | A | 11/2016 |
| CN | 106687383 | A | 5/2017 |
| CN | 108609285 | A | 10/2018 |
| CN | 208119630 | U | 11/2018 |
| CN | 106233083 | | 7/2019 |
| CN | 110191654 | | 8/2019 |
| CN | 110267883 | | 9/2019 |
| CN | 110536844 | | 12/2019 |
| CN | 110536845 | | 12/2019 |
| CN | 305553099 | | 1/2020 |
| CN | 305751278 | | 5/2020 |
| CN | 306079204 | | 9/2020 |
| CN | 112424547 | | 2/2021 |
| CN | 112585416 | | 3/2021 |
| CN | 112739630 | | 4/2021 |
| CN | 112955703 | | 6/2021 |
| CN | 112996411 | | 6/2021 |
| CN | 113023106 | | 6/2021 |
| DE | 2609519 | A1 | 9/1977 |
| DE | 3020740 | A1 | 12/1981 |
| DE | 4211951 | A1 | 10/1993 |
| DE | 20110247 | | 12/2002 |
| DE | 10146618 | A1 | 4/2003 |
| DE | 202004010081 | | 9/2004 |
| DE | 202007001638 | | 5/2007 |
| DE | 202009015164 | | 3/2010 |
| DE | 202013007655 | | 1/2015 |
| DE | 102013016278 | A1 | 4/2015 |
| DE | 102019200065 | | 1/2019 |
| DE | 102019200067 | | 1/2019 |
| DE | 102019200068 | | 1/2019 |
| DE | 102019200070 | | 1/2019 |
| DE | 112017005901 | | 8/2019 |
| DE | 102019200063 | | 7/2020 |
| DE | 102019200064 | | 7/2020 |
| EP | 1765109 | | 3/2007 |
| EP | 2514687 | A1 | 10/2012 |
| EP | 2534026 | | 12/2012 |
| EP | 3334665 | | 6/2018 |
| EP | 3571126 | | 11/2019 |
| EP | 3583050 | | 12/2019 |
| EP | 3585707 | | 1/2020 |
| EP | 3821186 | | 5/2021 |
| EP | 3826941 | | 6/2021 |
| EP | 3841338 | | 6/2021 |
| EP | 3856658 | | 8/2021 |
| EP | 3874211 | | 9/2021 |
| EP | 3876785 | | 9/2021 |
| EP | 3436368 | | 12/2021 |
| EP | 4019428 | | 6/2022 |
| EP | 4029806 | | 7/2022 |
| ES | 1030365 | | 8/1995 |
| GB | 1198352 | A | 7/1970 |
| GB | 1266593 | A | 3/1972 |
| HK | 1256949 | | 10/2019 |
| IN | 109195880 | | 1/2019 |
| JP | H09-66971 | A | 3/1997 |
| JP | 11006677 | | 1/1999 |
| JP | 2003-128163 | A | 5/2003 |
| JP | 2004299764 | A | 10/2004 |
| JP | 2005053510 | A | 3/2005 |
| JP | 2013-169998 | A | 9/2013 |
| JP | 3205193 | U | 7/2016 |
| KR | 1020040080384 | | 9/2004 |
| KR | 20090043694 | A | 5/2009 |
| KR | 20110000450 | U | 1/2011 |
| KR | 1020180136462 | | 12/2018 |
| KR | 1020190122725 | | 10/2019 |
| KR | 1020210038924 | | 4/2021 |
| KR | 1020210040356 | | 4/2021 |
| KR | 1020210048496 | | 5/2021 |
| KR | 1020210072022 | | 6/2021 |
| KR | 1020210084483 | | 7/2021 |
| MX | 04001493 | | 12/2004 |
| MX | 06014878 | | 10/2007 |
| MX | 2018011945 | | 9/2019 |
| MX | 2019009851 | | 12/2019 |
| MX | 2019010120 | | 12/2019 |
| WO | 0209975 | A1 | 2/2002 |
| WO | 2005123539 | | 12/2005 |
| WO | 2006007266 | | 1/2006 |
| WO | 2006009537 | | 1/2006 |
| WO | 2007016092 | | 2/2007 |
| WO | 2008013973 | | 1/2008 |
| WO | 2011094355 | | 8/2011 |
| WO | 2011100522 | | 8/2011 |
| WO | WO2017172029 | | 10/2017 |
| WO | 2018095957 | | 5/2018 |
| WO | WO2018107087 | | 6/2018 |
| WO | WO2018152367 | | 8/2018 |
| WO | WO2018156481 | | 8/2018 |
| WO | WO2018165164 | | 9/2018 |
| WO | WO2019231934 | | 12/2019 |
| WO | 2020013913 | | 1/2020 |
| WO | WO2020023520 | | 1/2020 |
| WO | 2020041236 | | 2/2020 |
| WO | WO2020069444 | | 4/2020 |
| WO | 2020091849 | | 5/2020 |
| WO | WO2020092023 | | 5/2020 |
| WO | WO2020176294 | | 9/2020 |
| WO | 2021050253 | | 3/2021 |
| WO | 2021050255 | | 3/2021 |
| WO | 2021050298 | | 3/2021 |
| WO | 2021086620 | | 5/2021 |
| WO | 2021145971 | | 7/2021 |
| WO | 2021154394 | | 8/2021 |
| WO | 2022081513 | | 4/2022 |
| WO | 2022189901 | A1 | 9/2022 |
| WO | 2022189904 | A1 | 9/2022 |
| WO | 2022238971 | A1 | 11/2022 |

OTHER PUBLICATIONS

US Design U.S. Appl. No. 29/708,155, filed Oct. 3, 2019 titled Latch.

US Design U.S. Appl. No. 29/708,156, filed Oct. 3, 2019 titled Latch.

Dometic Product Catalog—Coolers; 2015.

Dometic Product Catalog—Coolers; 2016.

US Design U.S. Appl. No. 29/820,716, filed Dec. 23, 2021 titled Container.

US Design U.S. Appl. No. 29/820,717, filed Dec. 23, 2021 titled Container.

U.S. Appl. No. 17/668,767, filed Feb. 10, 2022 titled Insulated Container.

U.S. Appl. No. 17/720,019, filed Apr. 13, 2022 titled Packable Cooler Bag.

PCT Application No. PCT/IB2022/056075 filed Jun. 29, 2022 titled Soft-Sided Cooler.

U.S. Appl. No. 63/353,281, filed Jun. 17, 2022 titled Insulated Container.

PCT Application No. PCT/US2022/031282 filed May 27, 2022 titled Insulated Container.

U.S. Appl. No. 17/825,374, filed May 26, 2022 titled Mobile Cooling Box with Ice Maker.

US Design U.S. Appl. No. 29/840,161, filed May 26, 2022 titled Cooler Fender Frame.

(56) References Cited

OTHER PUBLICATIONS

U.S. Appl. No. 17/872,514, filed Jul. 25, 2022 titled Mobile Cooling Box with Hinge Module.
U.S. Appl. No. 17/874,162, filed Jul. 26, 2022 titles Thermal Insulation Bag.
PCT Application No. PCT/US2022/026932 filed Apr. 29, 2022 titled Accessory Grid Apparatus for a Cooler.
U.S. Appl. No. 17/875,693, filed Jul. 28, 2022 titled Containment System Including a Soft Container.
US Design U.S. Appl. No. 29/836,642, filed Apr. 28, 2022 titled Half Sleeve Ice Block.
US Design U.S. Appl. No. 29/823,704, filed Jan. 19, 2022 titled Insulated Box.
MX Application No. MX/f/2022/002028 filed Jul. 19, 2022 titled Insulated Box.
EU App. No. 009092620 filed Jul. 19, 2022 titled Insulated Box.
U.S. Appl. No. 17/874,701, filed Jul. 27, 2022 titled Locking Module for a Container.
PCT Application No. PCT/US2022/038492 filed Jul. 27, 2022 titled Locking Module for a Container.
U.S. Appl. No. 17/887,106, filed Aug. 12, 2022 titled Cooler.
U.S. Appl. No. 17/886,803, filed Aug. 12, 2022 titled Mobile Cooling Box with Handle Module.
Extended European Search Report issued in European Patent Application No. 19879731.8 mailed on Oct. 20, 2022.
Notice of Allowance issued in U.S. Appl. No. 17/000,862 mailed on Oct. 20, 2022.
Final Office Action issued in U.S. Appl. No. 17/006,282 mailed on Nov. 16, 2022.
"Hightide lacing braid dead pulp box large size" (Rakuten) Nov. 22, 2016 (Nov. 22, 2016), retrieved from Internet, <URL: https://global.rakuten.com/en/store/1em-rue/item/948-rs001/>; entire document, especially Fig. 1-4, product Information.
23 3/4" × 14" White Foam Food Pan Carrier (webstaurantstore.com) Jul. 28, 2016 (Jul. 28, 2016), retrieved from Internet, https://www.webstaurantstore.com/restaurant-storage-transport.html; entire document especially, Fig. 1, 5, specs.
"30 Qt. Promo Cooler" (homedepot.com) Nov. 8, 2015 (Nov. 8, 2015), retrieved from Internet, https://www.homedepot.com/p/30-Qt-Promo-Cooler-3542/203336080, entire document especially Fig. 1, product overview.
"Cool sustainability: Vericool provides environmental edge with innovative chill packs", Retrieved from the Internet: URL: https://www.packaginginsights.com/news/chilled-packaging-vericool-coolers-provide-sustainable-edge-in-fresh-food-delivery.html, Sep. 3, 2018, 2 pages.
International Search Report and Written Opinion issued in PCT/US2019/037896, mailed Sep. 16, 2019, 11 pages.
NS Packaging, Vericool unveils sustainable product lines: URL: https://www.nspackaging.com/news/vericoolsustainable-coolers/, Oct. 15, 2018, 2 pages.
Vericool Inc, To Unveil Revolutionary Reusable Sustainable Consumer Cooler, at 2018 Pack Expo in Chicago, Oct. 11, 2018, 2 Pages.
Office Action and Search Report issued in Chinese Application No. 201980071993.2 dated May 27, 2022, 10 pages.
Partial Supplementary European Search Report issued in EP Patent Application No. 19879731.8 mailed on Jul. 8, 2022.
Australia Patent Application No. 2019371335 titled "Single-Walled Disposable Cooler Made of Disposable, Biodegradable And/Or Recyclable Material" filed on Aug. 4, 2021.
Canada Patent Application No. 3117297 titled "Single-Walled Disposable Cooler Made of Disposable, Biodegradable And/Or Recyclable Material" filed on Apr. 21, 2021.
Chinese Patent Application No. 201980071993.2 titled "Single-Walled Disposable Cooler Made of Disposable, Biodegradable And/Or Recyclable Material" filed on Apr. 21, 2021.
European Patent Application No. 19879731.8 titled "Single-Walled Disposable Cooler Made of Disposable, Biodegradable And/Or Recyclable Material" filed on Feb. 6, 2021.
Japanese Patent Application No. 2021-524237 titled "Single-Walled Disposable Cooler Made of Disposable, Biodegradable And/Or Recyclable Material" filed on Jun. 5, 2021.
Korean Patent Application No. 10-2021-7013187 titled "Single-Walled Disposable Cooler Made of Disposable, Biodegradable And/Or Recyclable Material" filed on Apr. 30, 2021.
Mexican Patent Application No. MX/a/2021/005094 titled "Single-Walled Disposable Cooler Made of Disposable, Biodegradable And/Or Recyclable Material" filed on Apr. 30, 2021.
PCT Patent Application No. PCT/US2019/037896 titled "Single-Walled Disposable Cooler Made of Disposable, Biodegradable And/Or Recyclable Material" filed on Jun. 19, 2019.
International Preliminary Report on Patentability issued in PCT Patent Application No. PCT/US2019/037896 mailed on May 14, 2021.
U.S. Appl. No. 62/754,829 titled "Single-Walled Disposable Cooler Made of Disposable, Biodegradable And/Or Recyclable Material" filed on Nov. 2, 2018.
U.S. Appl. No. 16/445,566 titled "Single-Walled Disposable Cooler Made of Disposable, Biodegradable And/Or Recyclable Material" filed on Jun. 19, 2019.
U.S. Appl. No. 62/898,117 titled "Biodegradable Cooler" filed on Sep. 10, 2019.
PCT Application No. PCT/US2020/047621 titled "Biodegradable Cooler" filed on Aug. 24, 2020.
International Preliminary Report on Patentability issued in PCT Application No. PCT/US2020/047621 mailed on Mar. 24, 2022.
European Patent Application No. 20862298.5 titled "Biodegradable Cooler" filed on Mar. 9, 2022.
China Patent Application No. 202080063536.1 titled "Biodegradable Cooler" filed on Mar. 10, 2022.
Australia Patent Application No. 2020345686 titled "Biodegradable Cooler" filed on Mar. 9, 2022.
U.S. Appl. No. 62/898,084 titled "Cooler With Carry Handle" filed on Sep. 10, 2019.
U.S. Appl. No. 17/000,862 titled "Cooler With Carry Handle" filed on Aug. 24, 2020.
Non-Final Office Action issued in U.S. Appl. No. 17/000,862 mailed on Nov. 15, 2021.
Ex-Parte Quayle Action issued in U.S. Appl. No. 17/000,862 mailed on Mar. 25, 2022.
Notice of Allowance issued in U.S. Appl. No. 17/000,862 mailed on Jun. 15, 2022.
PCT Application No. PCT/US2020/047617 titled "Cooler With Carry Handle" filed on Aug. 24, 2020.
International Search Report and Written Opinion issued in PCT Application No. PCT/US2020/047617 mailed on Feb. 16, 2021.
International Preliminary Report on Patentability issued in PCT Application No. PCT/US2020/047617 mailed on Mar. 24, 2022.
European Application No. 20862934.5 titled "Cooler With Carry Handle" filed on Mar. 9, 2022.
China Application No. 202080063584.0 titled "Cooler With Carry Handle" filed on Mar. 10, 2022.
Australia Application No. 2020346704 titled "Cooler With Carry Handle" filed on Mar. 9, 2022.
U.S. Appl. No. 62/898,089 titled "Double-Walled, Slip Fit Cooler" filed on Sep. 10, 2019.
U.S. Appl. No. 17/006,282 titled "Double-Walled, Slip Fit Cooler" filed on Aug. 28, 2020.
Non-Final Office Action issued in U.S. Appl. No. 17/006,282 mailed on Sep. 7, 2021.
Final Office Action issued in U.S. Appl. No. 17/006,282 mailed on Jan. 5, 2022.
Advisory Action issued in U.S. Appl. No. 17/006,282 mailed on Apr. 21, 2022.
Non-Final Office Action issued in U.S. Appl. No. 17/006,282 mailed on Jun. 29, 2022.
PCT Application No. PCT/US2020/048504 titled "Double-Walled, Slip Fit Cooler" filed on Aug. 24, 2020.
International Search Report and Written Opinion issued in PCT Application No. PCT/US2020/048504 mailed on Nov. 20, 2020.
International Preliminary Report on Patentability issued in PCT Application No. PCT/US2020/048504 mailed on Mar. 24, 2022.

(56) References Cited

OTHER PUBLICATIONS

European Application No. 20862669.7 titled "Double-Walled, Slip Fit Cooler" filed on Mar. 9, 2022.
China Application No. 202080063537.6 titled "Double-Walled, Slip Fit Cooler" filed on Mar. 10, 2022.
Australia Application No. 2020345695 titled "Double-Walled, Slip Fit Cooler" filed on Mar. 9, 2022.
Office Action issued in Chinese Application No. 201980071993.2 dated Oct. 19, 2022.
Non-Final Office Action issued in U.S. Appl. No. 16/445,566 mailed on Jan. 30, 2023.
Notice of Allowance issued in U.S. Appl. No. 17/000,862 mailed on Feb. 8, 2023.
Non-Final Office Action issued in U.S. Appl. No. 17/006,282 mailed on Apr. 17, 2023.
Advisory Action issued in U.S. Appl. No. 17/006,282 mailed Mar. 15, 2023.
Corrected Notice of Allowability issued in U.S. Appl. No. 17/000,862 mailed on Apr. 27, 2023.
Office Action issued in Chinese Application No. 201980071993.2 dated Feb. 3, 2023.
Office Action issued in Japanese Application No. 2021-524237 dated Apr. 4, 2023.
Office Action issued in Japanese Application No. 2021-524237 dated Dec. 5, 2023.
Extended European Search Report issued in European Patent Application No. 20862298.5 mailed on Nov. 13, 2023.
Office Action issued in Chinese Application No. 202080063584.0 dated Jan. 22, 2024.
Office Action issued in Chinese Application No. 202080063536.1 dated Feb. 22, 2024.
Extended European Search Report issued in European Patent Application No. 20862934.5 mailed on Sep. 8, 2023.
Extended European Search Report issued in European Patent Application No. 20862669.7 mailed on Sep. 12, 2023.
Final Office Action issued in U.S. Appl. No. 17/006,282 mailed on Sep. 20, 2023.
Advisory Action issued in U.S. Appl. No. 17/006,282 mailed on Jan. 29, 2024.
Office Action issued in Chinese Application No. 202080063536.1 mailed on Aug. 22, 2024.
Office Action issued in China Application No. 202080063537.6 mailed on Sep. 10, 2024.
Office Action issued in Japanese Application No. 2021-524237 dated Sep. 3, 2024.
Office Action issued in Mexican Application No. MX/a/2021/005094 dated Jul. 26, 2024.
Office Action issued in EP Application No. 19879731.8 dated Sep. 10, 2024.
Office Action issued in Korean Application No. 10-2021-7013187 dated Sep. 3, 2024.
Non-Final Office Action issued in U.S. Appl. No. 17/006,282 mailed on Mar. 18, 2024.
Office Action issued in China Application No. 202080063537.6 mailed on Mar. 19, 2024.
Final Office Action issued in U.S. Appl. No. 17/006,282 mailed on Jul. 9, 2024.
Li et al., "Package Design", Northern United Publishing and Media (Group) Co., Ltd. Liaoning Fine Arts Publishing House, p. 77, May 31, 2011.
Office Action issued in CN Application No. 202080063536.1 dated Feb. 11, 2025.

* cited by examiner

BIODEGRADABLE COOLER

RELATED APPLICATIONS

The present application claims priority under 35 U.S.C. § 119 to U.S. Provisional Application No. 62/898,117, entitled "Biodegradable Cooler", filed on Sep. 10, 2019, the entirety of which is incorporated by reference herein.

TECHNICAL FIELD

The present disclosure relates generally to coolers, and more particularly, to a cooler with carry handle made of a biodegradable material.

BACKGROUND

Coolers, ice chests, ice boxes, or the like are commonly used to store contents (e.g., food, beverages, etc.) and keep the contents cool. While many coolers are constructed using durable materials intended for repeated use, other coolers have been manufactured to be disposable. Coolers of the disposable variety are conventionally made from polystyrene foam (i.e., Styrofoam).

The use of polystyrene is problematic because it is a non-biodegradable solid. Disposal of polystyrene coolers, consequently, can cause significant environmental harm as discarded polystyrene will persist in the environment for centuries. Many cities and counties across the United States have passed regulations banning sale of polystyrene products for this reason.

Further, many coolers of the disposable variety generally use indentations created in the walls of the cooler. These indentations require users to use both hands in transporting the cooler from one place to another, thereby not allowing the user to have a free hand in carrying other items. Thus, a cooler that is made from a biodegradable material and that has a handle that allows users to carry the cooler with just one hand may be desirable.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1A:
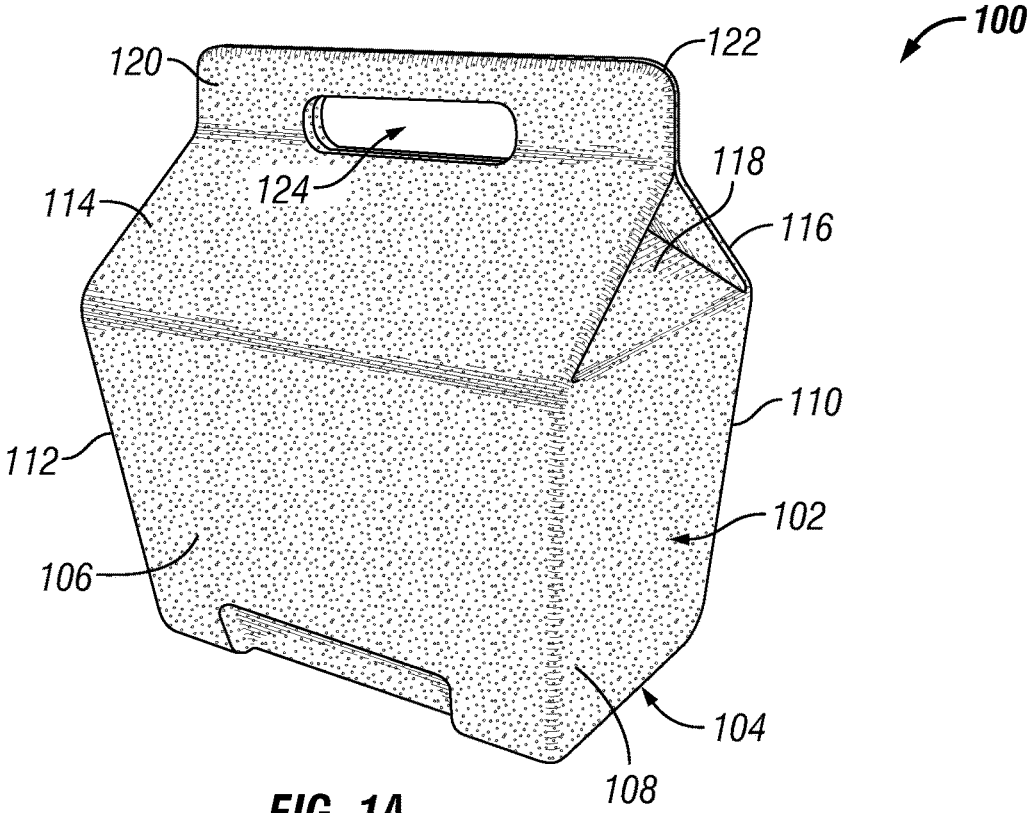
FIGS. 1A and 1B show perspective views of a biodegradable cooler with a handle according to an embodiment.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to embodiments of the present disclosure, the biodegradable cooler discussed herein can be made of a biodegradable material, such as a pulp-based material, or made from paper, sugar cane, hemp, bamboo, or the like. Because the pulp-based material, or other similar type material, is compostable, recyclable, and/or biodegradable, the cooler can be disposed in an environmentally friendly manner in which the cooler degrades rapidly relative to conventional polystyrene coolers and without toxic residues.

Figure 1B:
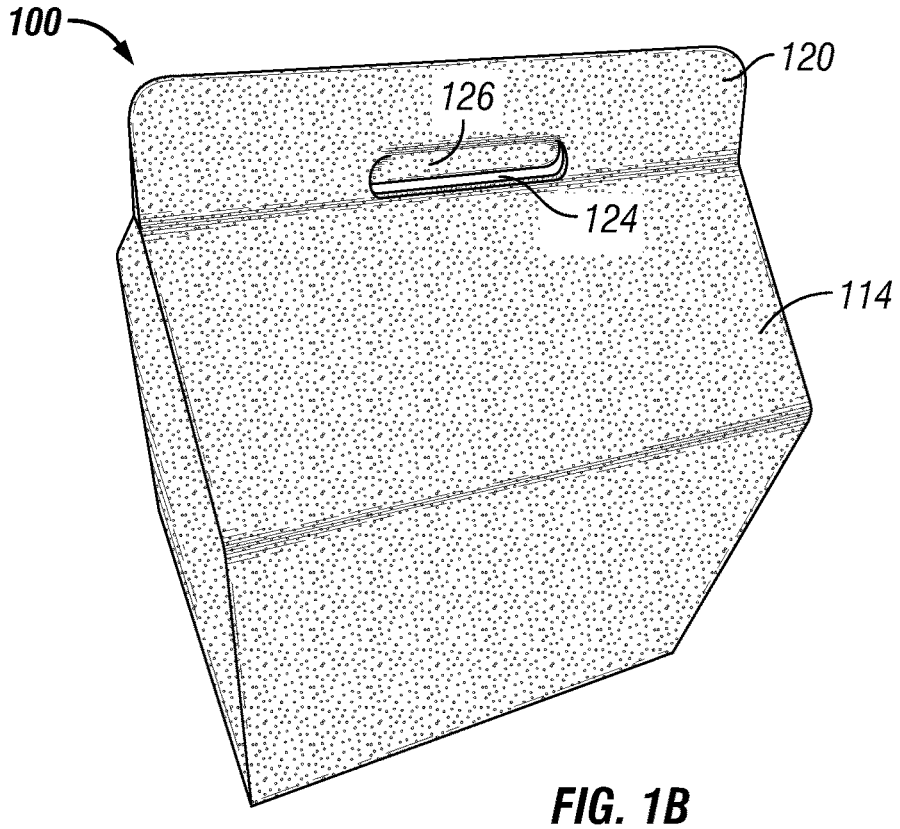
Figure 2A:
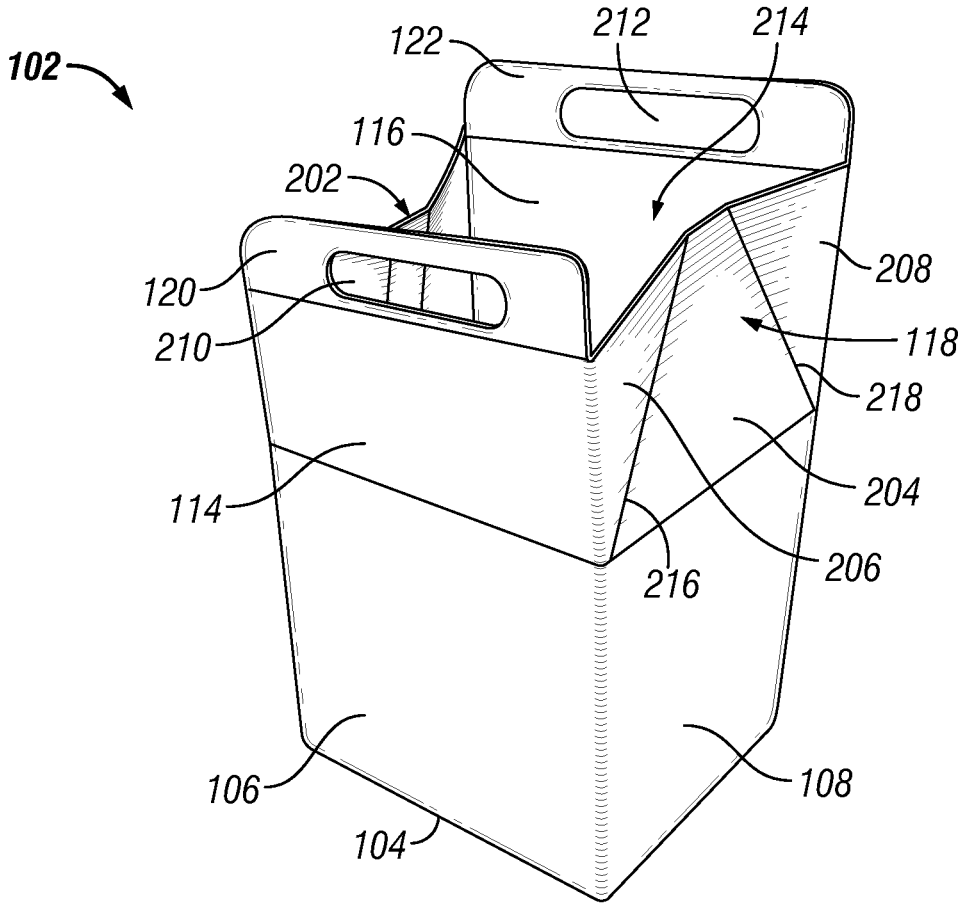
FIGS. 2A-2C show different views of the outer shell of the biodegradable cooler of FIG. 1A according to an example embodiment.
Figure 2B:
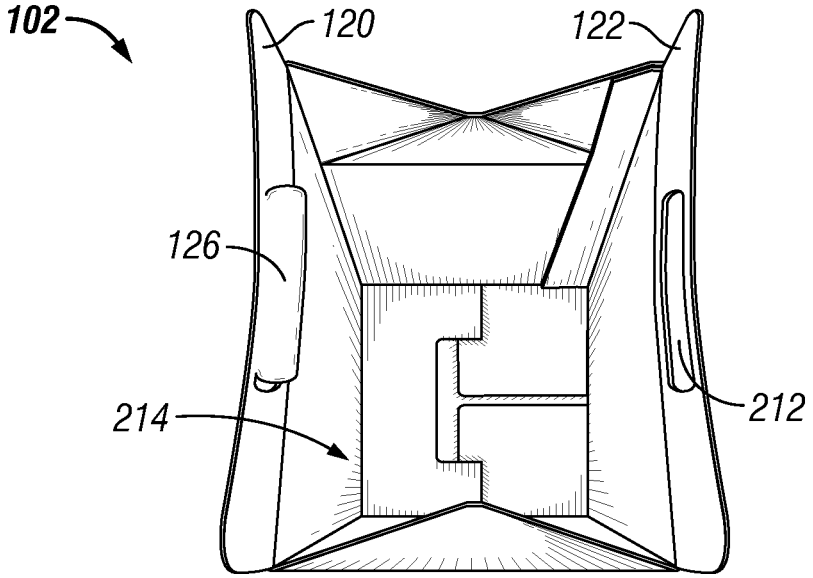
Figure 2C:
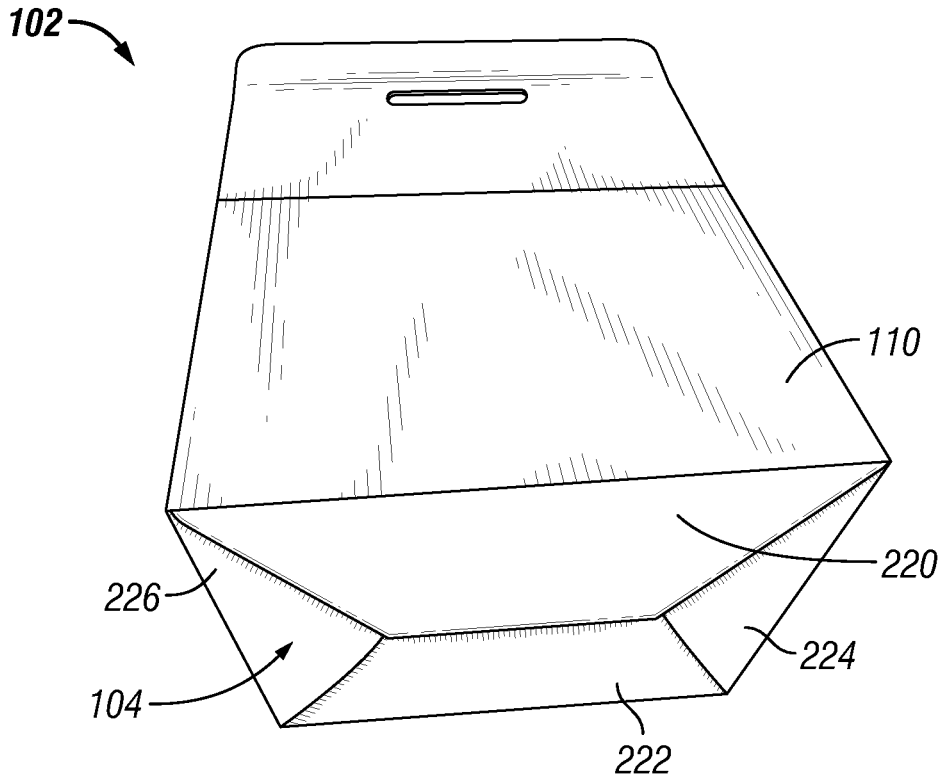
Figure 3A:
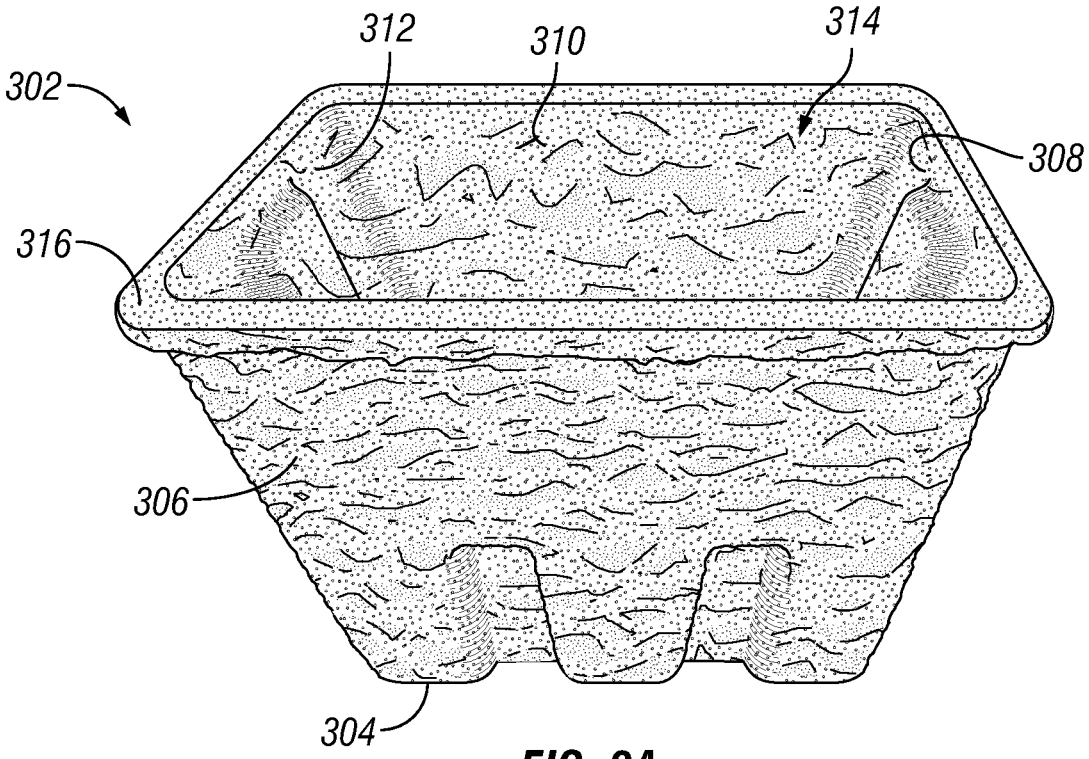
FIGS. 3A and 3B show different views of the liner of the biodegradable cooler of FIG. 1A according to an example embodiment.
Figure 3B:
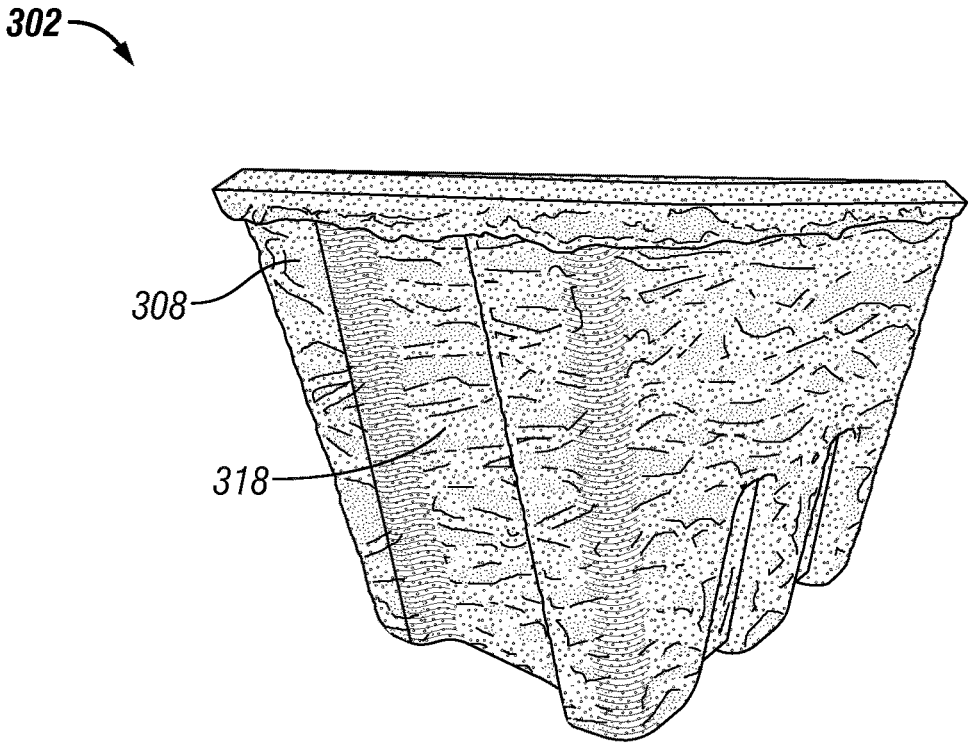
Figure 4:
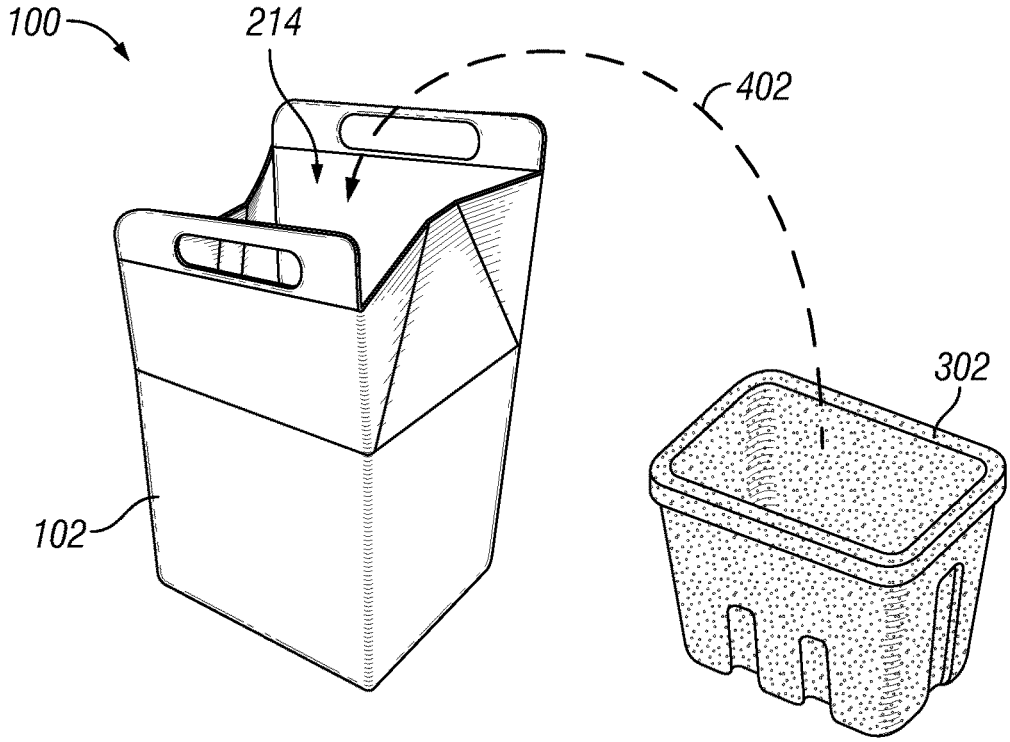
FIG. 4 shows the liner of FIG. 3A prior to being inserted in the cavity of the outer shell of FIGS. 2A-2C according to an example embodiment.
Figure 5:
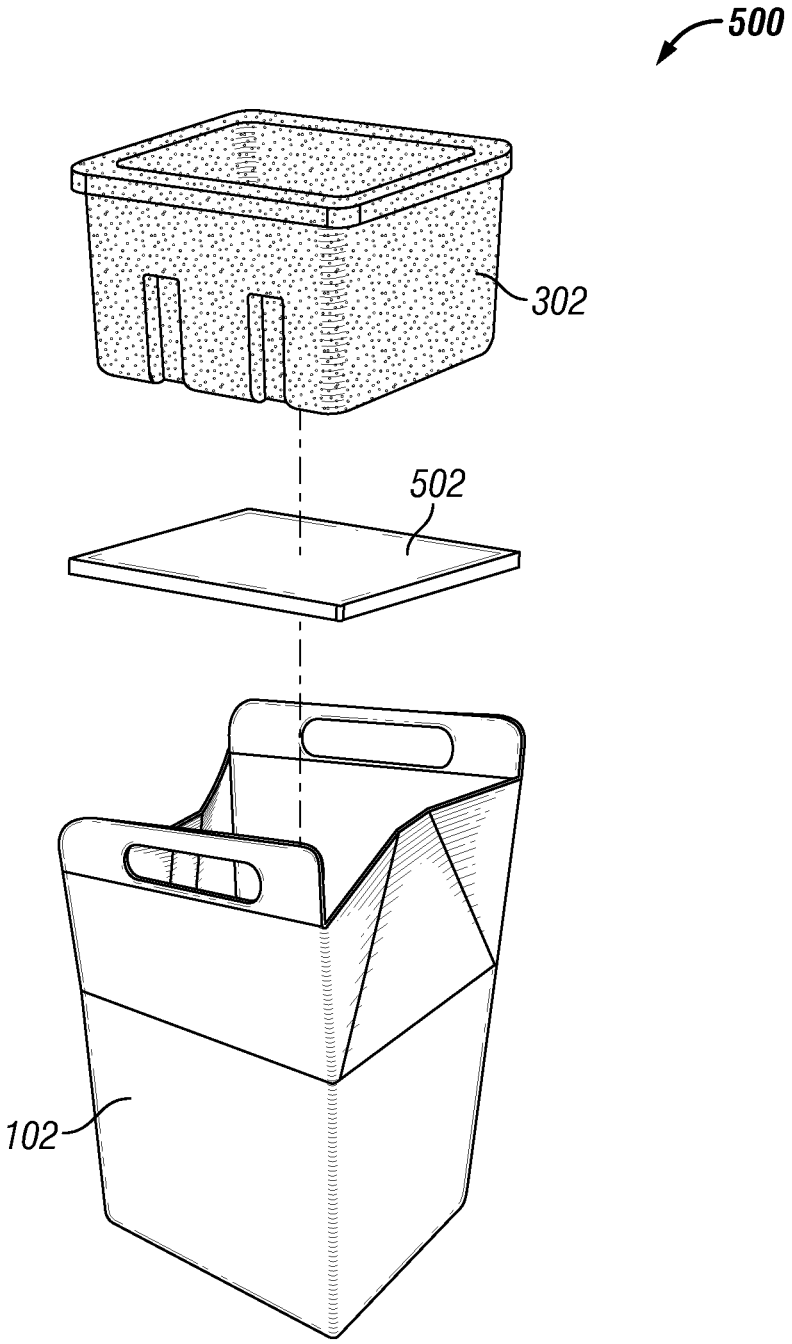
FIG. 5 shows an exploded view of a biodegradable cooler with a handle according to another embodiment.
Figure 8:
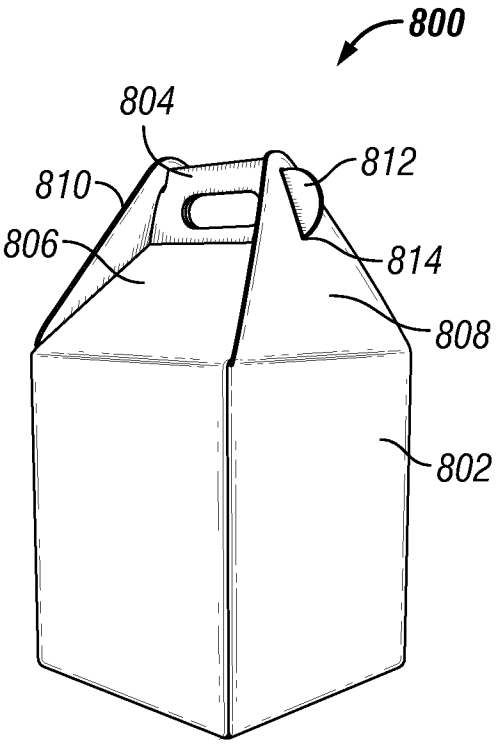
FIG. 8 shows a perspective view of a biodegradable cooler according to another example embodiment.
Figure 7:
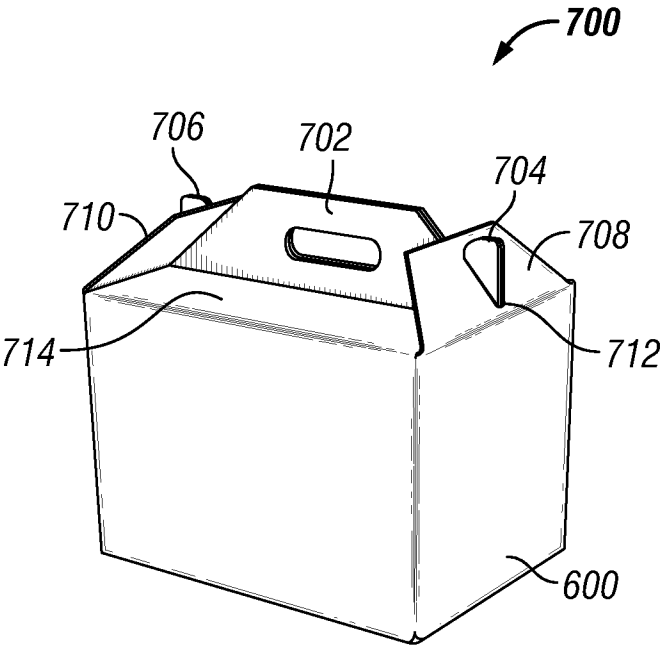
FIG. 7 shows a perspective view of a biodegradable cooler that includes the outer shell of FIG. 6 according to another example embodiment.
Figure 6:
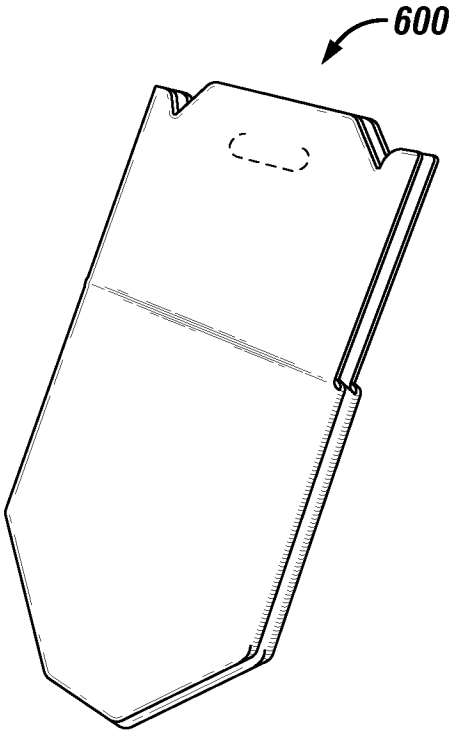
FIG. 6 shows an outer shell of a biodegradable cooler prior to being expanded to receive a liner according to another example embodiment.

The accompanying figures illustrate various embodiments of the disclosed biodegradable cooler. As described in detail hereinbelow, FIGS. 1A and 1B show perspective views of a biodegradable cooler with a handle according to an embodiment; FIGS. 2A-2C show different views of the outer shell of the biodegradable cooler of FIG. 1A according to an example embodiment; FIGS. 3A and 3B show different views of the liner of the biodegradable cooler of FIG. 1A according to an example embodiment; FIG. 4 shows a liner prior to being inserted in the cavity of the outer shell of FIGS. 2A-2C according to an example embodiment; FIG. 5 shows an exploded view of a biodegradable cooler with a handle according to another embodiment; FIG. 6 shows an outer shell of a biodegradable cooler prior to being expanded to receive a liner according to another example embodiment; FIG. 7 shows a perspective view of a biodegradable cooler that includes the outer shell of FIG. 6 according to another example embodiment; and FIG. 8 shows a perspective view of a biodegradable cooler according to another example embodiment.

It is understood that the aforementioned embodiments and features associated therewith are not mutually exclusive of each other. Any of the features shown to be associated with an embodiment described herein may be adopted in another embodiment described herein. Therefore, the description herein of various embodiments does not imply that any features associated with a particular embodiment are limited solely to said embodiment.

FIGS. 1A and 1B show perspective views of a biodegradable cooler 100 with a handle according to an embodiment. In some example embodiments, the biodegradable cooler 100 includes an outer shell 102 and a liner (shown in FIGS. 3 and 4) that is disposed within the outer shell 102. The outer shell 102 may include a base 104 and support walls including a side wall 106, an end wall 108, a side wall 110, and an end wall 112. The support walls may each be coupled to the base 104 and may extend up from the base 104. For example, the side wall 106 and the side wall 110 may extend up from the base 104 at opposite sides of the base 104 from each other, and the end wall 108 and the end wall 112 may extend up from the base 104 at opposite sides of the base 104 from each other. To illustrate, the end walls 108, 112 are coupled to and extend between the side walls 106, 110 at opposite ends of the base 104.

In some example embodiments, the support walls including the side wall 106, the end wall 108, the side wall 110, and the end wall 112 may be continuously and seamlessly coupled to the base 104. In some example embodiments, all of the side wall 106, the end wall 108, the side wall 110, and the end wall 112 may extend up vertically from the base 104. Alternatively, one or more of the side wall 106, the end wall 108, the side wall 110, and the end wall 112 may extend up from the base 104 at a slightly slanted angle from the vertical. For example, the side walls 106, 110 may be slanted outwardly away from each other as the side walls 106, 110 extend up from the base 104 at opposite sides of the base 104, and the end wall 108 and the opposite end wall may extend up vertically or at a slightly slanted angle.

In some example embodiments, the outer shell 102 may also include roof sections 114, 116, 118 and another roof section opposite the roof section 116. To illustrate, all roof sections of the outer shell 102 including the roof sections 114, 116, 118 may be coupled to and extend from a respective one of the support walls. For example, the roof section 114 and the base 104 may be coupled to the side wall 106 at opposite ends of the side wall 106, and the roof section 116 and the base 104 may be coupled to the side wall 110 at opposite ends of the side wall 110. In some example embodiments, the base 104 and the roof section 118 may be coupled to the end wall 108 at opposite ends of the end wall 108, and the base 104 and the roof section that is opposite the roof section 118 may be coupled to the end wall 112 at opposite ends of the end wall 112. When the outer shell 102 is closed as shown in FIGS. 1A and 1B, the roof sections 114 and 116 may be slanted toward each other as each roof section 114, 116 extends up from the respective side wall 106 or 110. As shown in FIGS. 1A and 1B, the roof section 114 and the roof section 116 may form a tent-top shape when the outer shell 102 is closed. For example, when the outer shell 102 is closed, the perimeters of the roof section 114, the end wall 108, and the roof section 116 may form a triangular shape as more clearly shown in FIG. 1A. Similarly, the perimeters of the roof section 114, the end wall 112, and the roof section 116 may form a triangular shape. The roof section 118 and the roof section that is opposite the roof section 118 may also be slanted toward each other when the outer shell 102 is closed as shown in FIGS. 1A and 1B.

In some example embodiments, some or all of the roof sections of the outer shell 102 including the roof sections 114, 116, 118 may be continuously and seamlessly coupled to the respective one of the support walls. For example, the roof section 114 may be continuously and seamlessly coupled to the side wall 106. Similarly, the roof section 116 may be continuously and seamlessly coupled to the side wall 110. The roof section 118 may be similarly continuously and seamlessly coupled to the end wall 108, and the roof section that is opposite the roof section 118 may be continuously and seamlessly coupled to the end wall 112.

In some example embodiments, the outer shell 102 includes handle sections 120, 122. For example, the handle section 120 may be coupled to and extend up from the roof section 114, and the handle section 122 may be coupled to and extend up from the roof section 116. To illustrate, the handle section 120 and the handle section 122 are attached to each other when the outer shell 102 is closed as shown in FIGS. 1A and 1B. The outer shell 102 may be kept closed by a handle flap 126 of the handle section 120 that extends through a handle opening 124 and wraps over a portion of the handle section 122. Alternatively or in addition, the outer shell 102 may be kept closed using one or more fasteners (e.g., snap fasteners), clips, Velcro, and/or other means as can be readily contemplated by those of ordinary skill in the art with the benefit of this disclosure.

In some example embodiments, the outer shell 102 includes the handle opening 124 for inserting, for example, a hand therein to carry the cooler 100. For example, an opening in the handle section 120 may be at least partially aligned with an opening in the handle section 122 to provide the handle opening 124. The handle section 120 may be continuously and seamlessly coupled to the roof section 114, and the handle section 122 may be continuously and seamlessly coupled to the roof section 116. In some alternative embodiments, the handle opening 124 may have a different shape and/or different dimensions than shown in FIGS. 1A and 1B without departing from the scope of this disclosure. For example, the handle opening 124 may be circular, rectangular, etc. As another example, the handle opening 124 may be narrow, wider, longer, or shorter than shown.

In some example embodiments, the support walls (i.e., the side wall 106, the end wall 108, the side wall 110, and the end wall 112) and the roof sections 114, 116, 118, and the roof section opposite the roof section 118 may define a cavity of the outer shell 102 as more clearly shown in FIGS. 2A and 2B. In some example embodiments, the outer shell 102 may be made from one or more biodegradable materials. In some example embodiments, the outer shell 102 may be made from a corrugate material such as a recycled corrugate material using methods known to those of ordinary skill in the art with the benefit of this disclosure. In some example embodiments, the outer shell 102 may include a material that is not biodegradable.

In some alternative embodiments, the outer shell 102 may have a different shape than shown without departing from the scope of this disclosure. In some alternative embodiments, the sections of the outer shell 102 may have different dimensions and/or different relative dimensions with respect to each other than shown without departing from the scope of this disclosure. For example, the handle sections 120, 122 may be vertically shorter or longer than shown. As another example, some or all of the roof sections including the roof sections 114, 116 may be slanted more or less than shown without departing from the scope of this disclosure.

FIGS. 2A-2C show different views of the outer shell 102 of the biodegradable cooler 100 of FIG. 1A according to an example embodiment. Referring to FIGS. 1A-2C, in some example embodiments, the outer shell 102 includes the base 104 and the support walls including the side wall 106, the end wall 108, the side wall 110, and the end wall 112. The outer shell 102 may further include the roof sections 114, 116, 118 as well as a roof section 202 that is located opposite from the roof section 118. The roof sections 114 and 116 are located opposite from each other.

In some example embodiments, the roof section 118 may include outer areas 206, 208 and a middle area 204 that is between the outer areas 206 and 208. The outer area 206 may have a triangular shape and may border the roof section 114. The outer area 208 may have a triangular shape and may border the roof section 116. When the outer shell 102 is closed, the outer area 206 may overlap a portion of the roof section 114, and the outer area 208 may overlap a portion of the roof section 116. When the outer shell 102 is closed, the middle area 204 may provide a cover to a cavity 214 of the outer shell 102 as more clearly shown in FIG. 1A. The support walls (i.e., the side wall 106, the end wall 108, the side wall 110, and the end wall 112) and the roof sections 114, 116, 118, 202 may define the cavity 214 of the outer shell 102.

In some example embodiments, the roof section 202 may have similar areas as the roof section 118. For example, when the outer shell 102 is closed as shown in FIG. 1A, the outer areas of the roof section 202 may overlap the roof section 114 and the roof section 116 in a similar manner as the outer areas 206, 208 of the roof section 118. When the outer shell 102 is closed as shown in FIG. 1A, the middle area of the roof section 202 may provide a cover to the cavity 214 of the outer shell 102 in a similar manner as the middle area 204 of the roof section 118.

As more clearly shown in FIGS. 2A-2C, the handle section 120 is coupled to and extends up from the roof section 114, and the handle section 122 is coupled to and extends up from the roof section 116. As more clearly shown in FIGS. 2A and 2B, in contrast to the handle sections 120, 122 that extend up from the roof sections 114, 116, the outer shell 102 may not include handle sections that extend up from the roof sections 118, 202.

In some example embodiments, the handle section 120 includes an opening 210, and the handle section 122 includes an opening 212. For example, the opening 210 may be formed by partially cutting through an area of the handle section 120 to form the handle flap 126, and the opening 212 may be formed by cutting out an area of the handle section 122. When the outer shell 102 is closed as shown in FIGS. 1A and 1B, the openings 210 and 212 may at least partially overlap with each other to provide the handle opening 124, and the handle flap 126 may be pushed through the handle opening 124 and folded back toward the handle section 122 to retain the outer shell 102 closed.

In some example embodiments, the base 104 of the outer shell 104 may be formed from multiple bottom flaps 220-226 as more clearly shown in FIG. 2C. For example, the bottom flaps 220-226 may be folded up and interlocked forming the base 104 such that the outer shell 102 is closed by the base 104 on a bottom end when the outer shell 102 is oriented as shown in FIG. 2A. In some alternative embodiments, the bottom flaps 220-226 may be interlocked in a different configuration than shown in FIG. 2C. In some alternative embodiments, the outer shell 102 may include fewer than four bottom flaps without departing from the scope of this disclosure.

In some alternative embodiments, the relative sizes of the different areas of the roof section 118 may be different than shown without departing from the scope of this disclosure. some alternative embodiments, the openings 210, 212 may have different shapes and/or dimensions than shown without departing from the scope of this disclosure.

FIGS. 3A and 3B show different views of the liner 302 of the biodegradable cooler 100 of FIG. 1A according to an example embodiment. Referring to FIGS. 1A-3B, in some example embodiments, the liner 302 is sized to be positioned in the cavity 214 of the outer shell 102. The liner 302 may include a bottom wall 304 and side walls 306, 308, 310, 312. The side walls 306-312 are coupled to and extend up from the bottom wall 304 such that the bottom wall 304 and side walls 306-312 define a cavity 314 of the liner 302. The side walls 306 and 310 are coupled to the side wall 308 at opposite sides of the side wall 304, and the side walls 306 and 310 are coupled to the side wall 312 at opposite sides of the side wall 312.

In some example embodiments, all of the side walls 306-312 may extend up vertically from the bottom wall 304. Alternatively, one or more of the side walls 306-312 may extend up from the base 104 at a slightly slanted angle from the vertical. For example, the side walls 306, 310 may be slanted outwardly away from each other as the side walls 306, 310 extend up from the bottom wall 304 at opposite sides of the bottom wall 304, and the side walls 308, 312 may be slanted outwardly away from each other as the side walls 308, 312 extend up from the bottom wall 304 at opposite sides of the bottom wall 304.

In some example embodiments, the liner 302 may include a lip 316 that extends outwardly from the walls 306-312 at a top end of the liner 302. For example, the lip 316 may provide a surface for holding the line 302 when inserting and removing the liner 302 into and out of the outer shell 102. In some example embodiments, the liner 302 may also include indentations such as an indentation 318 formed in the side wall 308. For example, the indentations may provide added ease of carrying the liner 302. In some alternative embodiments, the lip 316 and/or the indentations, such as the indentation 318, may be omitted without departing from the scope of this disclosure.

In some example embodiments, the liner 302 may be entirely seamless. In general, the liner 302 may be made in various sizes compatible with the outer shell 102. That is, the liner 302 may be sized to fit inside the cavity 214 of the outer cooler 102 while allowing the liner 302 to be conveniently inserted into and removed from the cavity 214. For example, the liner 302 may have a larger size when the outer shell 102 is correspondingly larger, and the liner 302 may have a smaller size when the outer shell 102 is correspondingly smaller. In some example embodiments, the liner 302 may be made to have a rigidity such that the side walls of the liner 302 do not collapse.

In some example embodiments, the liner 302 may be made from a pulp-based material using a method such as, for example, molding, etc. Pulp, as is generally known in the art, is a fibrous material prepared by chemically or mechanically separating cellulose fibers from wood, recycled paper, straw, grass, or other raw fibrous materials. Pulp is understood to be more eco-friendly than polystyrene, as pulp can be biodegradable (i.e., capable of disintegrating into an innocuous material), recyclable (i.e., capable of being reused or treated for reuse), and/or compostable (i.e., capable of decomposing within 90-180 days), without release of toxic residues upon decomposition.

In some cases, the pulp-based material from which the liner 302 is made can be derived entirely from pre-consumer recycled paper. In other cases, the pulp-based material from which the liner 302 is made can derive from a combination of the recycled paper and a wax additive (e.g., paraffin wax) added to enhance the water resistance of the liner 302. In yet other cases, a small amount of rosin (a solid form of resin)

can be added to the pulp-based material to enhance the cooler's durability. It is understood, however, that the pulp-based material can be derived from any suitable pulp-producing materials generally known in the art. Additionally, the liner 302 can be formed from other biodegradable materials such as paper, sugar cane, hemp, jute, bamboo, and other similar type materials. In some example embodiments, the outer shell 102 may be made from a biodegradable such as a pulp-based material and/or other biodegradable materials such as paper, sugar cane, hemp, jute, bamboo, and other similar type materials.

FIG. 4 shows the liner 302 of FIG. 3A prior to being inserted in the cavity 214 of the outer shell 102 of FIGS. 2A-2C according to an example embodiment. Referring to FIGS. 1A-4, in some example embodiments, the liner 302 may be inserted in the cavity 214 of the outer shell 102 as illustrated by an arrow 402. For example, the cavity 314 of the liner 302 may be filled with items before the liner 302 is inserted in the cavity 214 of the outer shell 102. Alternatively, items may be placed in the cavity 314 of the liner 302 after the liner 302 is inserted in the cavity 214 of the outer shell 102. For example, items that need to be kept cold may be placed in the liner 302.

In general, the cooler 100 may be made by manufacturing the outer shell 102 to have a desired dimensions. For example, the outer shell 102 may be made from a recycled corrugate material or from another biodegradable material. The liner 302 may be manufactured to have dimensions such that the liner 302 fits in the cavity 214 of the outer shell 102. For example, the liner 302 may have the height H such that the top end of the liner 302 is below the roof sections 114, 116, 118, 202 and at or below the top end of the support walls (i.e., the side wall 106, etc.). To illustrate, the liner 302 may have the height H such that the roof sections 114, 116, 118, 202 of the outer shell 102 may be slanted to cover to the cavity 214 of the outer shell 102 as shown in FIG. 1A without interference by the liner 302.

In some example embodiments, after providing the outer shell 102 and the liner 302, the liner 302 may be inserted into the cavity 214. After the liner 302 is inserted in the cavity 214 of the outer shell 102, some items (e.g., ice, bottled drinks, etc.) may be placed in the cavity 314 of the liner 302. Alternatively, the items may be placed in the cavity 314 of the liner 302 before inserting the liner 302 in the cavity 214. After the liner 302 containing desired items is in place in the cavity 214 of the outer shell 102, the outer shell 102 may be closed by pushing the roof sections 114 and 116 toward each other until the handle sections 120 and 122 come in contact with each other and while slightly pushing the roof sections 118 and 202 inward toward each other. For example, the roof section 118 may be partially folded along creases 216, 218 as the middle area 204 of the roof section 118 is pushed inward, and the roof section 202 may be partially folded along similar creases as a corresponding middle area of the of the roof section 202 is pushed inward. The roof sections 114, 116, 118, 202 provide a cover to the cavity 214 of the outer shell 102 when the handle sections 120 and 122 are in contact with each other.

In some example embodiments, the liner 302 may be removed from the cavity 214 of the outer shell 102 by first opening the outer shell 102, for example, by pulling the handle sections 120 and 122 away from each other. For example, the liner 302 may be pulled out of the cavity 214 of the outer shell 102 by placing fingers between the liner 302 and the side walls 114, 116 and pulling the liner 302 upward.

In general, the biodegradable cooler 100 described herein can be made of a biodegradable material, such as a pulp-based material, that is compostable, recyclable, and/or biodegradable. As a result, the cooler can be disposed in an eco-friendly manner in which the cooler disintegrates in a compost environment rapidly relative to conventional polystyrene coolers and without leaving toxicity into the soil. The biodegradable material, such as a pulp-based material, used for fabricating the cooler described herein can comply with modern regulations prohibiting sale of polyethylene products, while providing consumers with a storage solution that is disposable. Moreover, the biodegradable cooler described herein can include convenient features such as a handle, and the like, and reliably retain water for long durations (e.g., two days).

FIG. 5 shows an exploded view of a biodegradable cooler 500 with a handle according to another embodiment. Referring to FIGS. 1-5, in some example embodiments, the biodegradable cooler 500 includes the outer shell 102, the liner 302, and bottom panel 502. The bottom panel 502 may be placed in the cavity 214 of the outer shell 102 prior to positioning the liner 302 in the cavity 214, and the liner 302 may be positioned on the bottom panel 502. For example, the bottom panel 502 may be positioned on the base 104 of the outer shell 102 to provide added sturdiness to the base 104, for example, when relatively heavier items are placed in the liner 302. To illustrate, the bottom panel 502 may help distribute the weight of the liner 302 and items that are placed in the liner 302, for example, evenly or away from the center of the base 104.

In some example embodiments, the bottom panel 302 may be made from corrugate material, such as recycled corrugate material, or from another biodegradable material. Alternatively, the bottom panel 302 may be made from or may include a material that is not biodegradable. The bottom panel 302 may be sized such that the perimeter of the bottom panel 302 is in contact with the walls of the outer shell 102. In some alternative embodiments, the bottom panel 302 may be sized to be smaller than the base 104.

FIG. 6 shows an outer shell 600 of a biodegradable cooler prior to being expanded to receive a liner according to another example embodiment. FIG. 7 shows a perspective view of a biodegradable cooler 700 that includes the outer shell 600 of FIG. 6 according to another example embodiment. Referring to FIGS. 6 and 7, in some example embodiments, the biodegradable cooler 700 includes the outer shell 600 and a liner, such as the liner 302 of FIGS. 3A and 3B. In some example embodiments, the biodegradable cooler 700 is similar to the biodegradable cooler 100 of FIG. 1A.

Focusing on the main differences between the outer shell 600 and the outer shell 102, in some example embodiments, the outer shell 600 may include top flaps 708, 710 instead of the roof sections 118, 202 of the outer shell 102 shown in FIG. 4. In some example embodiments, the roof sections, such as a roof section 714, of the outer shell 600 may be substantially flat in contrast to the slanted roof sections 114, 116 of the outer shell 102 of FIG. 1A.

In some example embodiments, the top flaps 708, 710 of the outer shell 600 provide slots, such as a slot 712 formed in the top flap 708, for retaining the outer shell 600 closed. To illustrate, tabs 704, 706 that extend out from the handle sections of the outer shell 600 may be inserted through the slots, such as a slot 712, to retain the outer shell 600 closed. For example, the tab 704 extends through the slot 712, and the tab 706 extends through the slot in the top flap 708.

In some example embodiments, the outer shell 600 may be made from the same material as the outer shell 102.

FIG. 8 shows a perspective view of a biodegradable cooler according to another example embodiment. In some example embodiments, the biodegradable cooler includes the outer shell 802 and a liner, such as the liner 302 of FIGS. 3A and 3B. In some example embodiments, the biodegradable cooler 800 is similar to the biodegradable cooler 100 of FIG. 1A and the biodegradable cooler 100 of FIG. 7.

Similar to the outer shell 102 of FIGS. 1A and 1*n* contrast to the outer shell 600 of FIG. 7, roof sections, such as a roof section 806, of the outer shell 802 are slanted. Similar to the outer shell 600 of FIG. 7 and in contrast to the outer shell 102 of FIG. 1A, the outer shell 802 may include top flaps 808, 810. However, in contrast to the outer shell 600 of FIG. 7 and similar to the outer shell 102 of FIG. 1A, the top flaps 808, 810 along with the roof sections, such as a roof section 806, may serve to provide a cover to the cavity of the outer shell 802.

In some example embodiments, the top flaps 808, 810 of the outer shell 802 provide slots, such as a slot 814 formed in the top flap 808, for retaining the outer shell 802 closed. To illustrate, tabs, such as a tab 812, that extend out from the handle sections (e.g., a handle section 804) of the outer shell 802 may be inserted through the slots, such as the slot 814, to retain the outer shell 802 closed. For example, the tab 812 extends through the slot 814.

In some example embodiments, the outer shell 802 may be made from the same material as the outer shell 102.

The foregoing description has been directed to certain embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A biodegradable cooler, comprising:

an outer shell comprising:

a base formed of two or more bottom flaps;

support walls coupled to the base;

two or more roof sections formed with and extending from the support walls, wherein the base, the support walls, and the two or more roof sections define an exterior of said outer shell and a cavity of the outer shell wherein each of said two or more roof sections are connected at adjacent ends to be continuously and seamlessly coupled;

said roof sections having upper edges; and, handle sections extending from the upper edges of two opposed roof sections of the two or more roof sections, wherein the handle sections are attached to each other when the outer shell is closed, and wherein to open said outer shell the handle sections are pulled apart; and a molded liner disposed within in the cavity of the outer shell, said molded liner comprising a liner bottom wall and one or more liner sidewalls extending from said molded liner bottom, an upper edge of said one or more liner sidewalls defining an upper height of said molded liner, wherein the outer shell and the molded liner are made from one or more biodegradable materials, wherein said upper height of said molded liner is less than a lower edge of said roof sections.

2. The biodegradable cooler of claim 1, wherein one or more of the support walls are continuously and seamlessly coupled to the base.

3. The biodegradable cooler of claim 1, wherein one or more of the roof sections are continuously and seamlessly coupled to a respective support wall of the support walls.

4. The biodegradable cooler of claim 1, wherein the outer shell is made from at least one biodegradable material.

5. The biodegradable cooler of claim 4, wherein the at least one biodegradable material is made a recycled corrugate material.

6. The biodegradable cooler of claim 4, wherein the molded liner is made from a pulp-based material.

7. The biodegradable cooler of claim 6, wherein the molded liner comprises a bottom wall and side walls, wherein the side walls are coupled to the bottom wall, wherein the bottom wall and the side walls define a cavity of the molded liner.

8. The biodegradable cooler of claim 7, wherein the molded liner is seamless.

9. The biodegradable cooler of claim 1, wherein the molded liner is enclosed inside the outer shell when the outer shell is closed.

10. The biodegradable cooler of claim 9, further comprising an inner surface of said roof sections varying spacing from said upper edge of said molded liner when said outer shell is closed.

11. The biodegradable cooler of claim 1, wherein a first roof section of the roof sections and a second roof section of the roof sections form a tent-top shape when the outer shell is closed, and wherein a third roof section and a fourth roof section form respective recesses.

12. The biodegradable cooler of claim 1, wherein the handle sections comprise a first handle section and a second handle section, wherein the first handle section extends from a first roof section of the roof sections, and wherein the second handle section extends from a second roof section of the roof sections.

13. The biodegradable cooler of claim 12, wherein a first opening in the first handle section is aligned with a second opening in the second handle section and wherein the first opening and the second opening provide a handle opening for inserting a hand therein to hold the biodegradable cooler.

14. The biodegradable cooler of claim 1, further comprising a bottom panel positioned between the molded liner and the base.

15. The biodegradable cooler of claim 1, said molded liner having one or more indentations along a surface thereof.

* * * * *